US005096456A

United States Patent [19]

Reinert et al.

[11] Patent Number: 5,096,456

[45] Date of Patent: Mar. 17, 1992

[54] THERMAL AND PHOTOCHEMICAL STABILISATION OF DYEINGS ON POLYAMIDE FIBRES: APPLICATION OF SULFONATED HINDERED PHENOLIC DERIVATIVE

[75] Inventors: Gerhard Reinert, Allschwil; Francesco Fuso, Münchenstein, both of Switzerland

[73] Assignee: Ciba-Geigy Corporation, Ardsley, N.Y.

[21] Appl. No.: 641,196

[22] Filed: Jan. 15, 1991

[30] Foreign Application Priority Data

Jan. 19, 1990 [CH] Switzerland ..... 173/90

[51] Int. Cl.[5] ..... D06M 13/25; D06P 1/62; D06P 3/24

[52] U.S. Cl. ..... 8/442; 8/490; 8/531; 8/586; 8/589; 8/590; 8/610; 8/662; 8/680; 8/685; 8/924; 562/44; 562/105

[58] Field of Search ..... 8/490, 589, 442, 490, 8/586, 589, 590

[56] References Cited

U.S. PATENT DOCUMENTS 3,665,031 5/1972 · Peterli et al. ..... 562/44

*Primary Examiner*—A. Lionel Clingman

*Attorney, Agent, or Firm*—George R. Dohmann; Marla J. Mathias

[57] ABSTRACT

A process for improving the thermal and/or photochemical stability of dyeings on polyamide fibres by applying to said fibres, from an aqueous medium, water-soluble phenolic antioxidants of formula $(A—Y—)_n$-$Z(—W)_m$, wherein A, Y, Z, W, m and n are as defined in claim 1.

13 Claims, No Drawings

THERMAL AND PHOTOCHEMICAL STABILISATION OF DYEINGS ON POLYAMIDE FIBRES: APPLICATION OF SULFONATED HINDERED PHENOLIC DERIVATIVE

STABILISATION OF DYEINGS ON POLYAMIDE FIBRES

The present invention relates to a process for improving the thermal and/or photochemical stability of dyeings on polyamide fibres and to the polyamide fibre material so treated.

It is taught in U.S. patent specification 3,665,031 to protect undyed polymers such as polyamides against the action of heat and/or oxygen (atmospheric oxygen) with the aid of water-soluble phenolic antioxidants.

Dyeings on polyamide fibres which are dyed with disperse, acid or 1:2 metal complex dyes tend to be thermally and photochemically instable. This tendency is especially marked when polyamide fibres are dyed with a red dye or with a dye mixture containing at least one red component.

It has now been found that this shortcoming can be entirely or at least substantially eliminated by treating the dyed polyamide material with phenolic water-soluble antioxidants.

The invention therefore relates to a process for improving the thermal and/or photochemical stability of dyeings on polyamide fibres, which process comprises applying to said polyamide fibres, from an aqueous medium, a compound of formula (1)

$$(A-Y-)_nZ(-W)_m \qquad (1)$$

wherein

A is the radical of a sterically hindered phenol of the benzene series,

Y is a radical of formula (2) or (3)

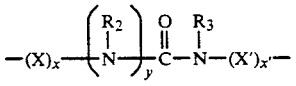

(2)

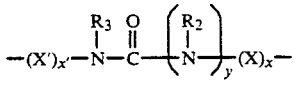

(3)

wherein

X and X' are each independently of the other alkylene, oxaalkylene or thiaalkylene, $R_2$ and $R_3$ are each independently of the other hydrogen or an unsubstituted or substituted alkyl group, and x, x' and y are each independently of the other 0 or 1, Z is an aliphatic or a carbocyclic aromatic radical, which last mentioned radical contains not more than two mono- or bicyclic nuclei, W is a sulfo group, and m and n are each independently of the other 1 or 2, and the water-soluble salts thereof.

A in formula (1) may be a monohydroxyphenyl radical which is substituted in at least one ortho-position to the hydroxyl group by an alkyl, cycloalkyl or aralkyl group and which may carry additional substituents.

Alkyl groups in ortho-position to the hydroxyl group in A may be straight-chain or branched and contain 1 to 12, preferably 4 to 8, carbon atoms. α-Branched alkyl groups are preferred. Such groups are typically methyl, ethyl, isopropyl, tert-butyl, isoamyl, octyl, tert-octyl and dodecyl. Tert-butyl is particularly preferred.

Cycloalkyl groups in o-position to the hydroxyl group in A contain 6 to 10, preferably 6 to 8, carbon atoms. Illustrative examples of such groups are cyclohexyl, methylcyclohexyl and cyclooctyl.

Aralkyl groups in o-position to the hydroxyl group in A contain 7 to 10, preferably 8 to 9, carbon atoms. Illustrative examples of such groups are the α-methyl and α,α-dimethylbenzyl group.

The radical A may be substituted by further alkyl, cycloalkyl or aralkyl groups as defined above, which groups are preferably in o'- or p-position to the hydroxyl group, provided these positions are not occupied by the bond to Y. In addition, the radical A is preferably unsubstituted in at least one m-position to the hydroxyl group, whereas the other may be substituted by lower alkyl groups such as the methyl group.

Owing to the ease with which they can be obtained and to their good stabilising action, compounds of formula (1) are especially preferred in which A is a radical of formula (4)

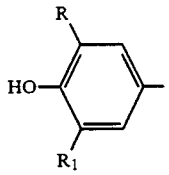

(4)

wherein

R and $R_1$ are each independently of the other hydrogen, methyl or tert-butyl, and the sum of the carbon atoms of R and $R_1$ is not less than 2.

X and X' in formulae (2) and (3) may be straight-chain or branched and contain 1 to 8, preferably 1 to 5, carbon atoms. Illustrative examples are the methylene, ethylene, trimethylene, propylene, 2-thiatrimethylene or the 2-oxapentamethylene radical.

Especially preferred are compounds in which two hetero atoms in the radicals X and X' are not attached to the same saturated, i.e. tetrahedral, carbon atom.

$R_2$ or $R_3$ in formulae (2) and (3) as alkyl groups may be straight-chain or branched and contain 1 to 8, preferably 1 to 8, carbon atoms. Such groups are typically methyl, ethyl, isopropyl, pentyl, octyl, dodecyl and octadecyl.

A substituted alkyl group $R_2$ or $R_3$ is typically a hydroxyalkyl, alkoxyalkyl, aminoalkyl, alkylaminoalkyl group or a dialkylaminoalkyl group containing a total of 2 to 10, preferably 2 to 5, carbon atoms. Illustrative examples of such groups are the β-hydroxyethyl, β-methoxyethyl, β-aminoethyl, β,β'-diethylaminoethyl or β-butylaminoethyl group.

$R_2$ or $R_3$ may also be an aryl group, preferably the phenyl group.

Particularly preferred compounds of formula (1) are those wherein Y is a radical of formula (5)

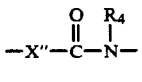

(5)

wherein $R_4$ is hydrogen or $C_1$–$C_4$alkyl and

X'' is $C_1$–$C_4$alkylene.

Z in formula (1) is, for example, the radical of an unsubstituted or carboxy-substituted lower alkane of at least two carbon atoms, the radical of an unsubstituted benzene nucleus or of a benzene nucleus which is substituted by chlorine or bromine, $C_1$–$C_4$alkyl, $C_1$–$C_4$alkoxy, $C_1$–$C_4$alkoxycarbonylamino, hydroxy, carboxy, phenylethyl, styryl, phenyl, phenoxy, phenylthio, phenylsulfonyl or acylamino, and the group W may be attached direct to said benzene nucleus or to a monocyclic aryl radical of one of the substituents thereof, or is a radical of a naphthalene or tetraline nucleus.

Z as radical of a lower alkane may be straight-chain or branched and contain 2 to 5, preferably 2, carbon atoms. Said radical may therefore be ethylene, propylene, trimethylene or pentamethylene. This radical may be substituted by carboxyl groups and is, for example, the carboxyethylene radical.

Z in formula (1) as a radical of a benzene nucleus may be further substituted and contain, for example, straight-chain or branched $C_1$–$C_4$alkyl groups such as methyl, ethyl or isopropyl. The preferred substituent is the methyl group. $C_1$–$C_4$Alkoxy groups as substituents of a benzene nucleus Z are, for example, methoxy, ethoxy or butoxy. If Z as a radical of a benzene nucleus is substituted by an acylamino group, then its acyl radical is derived preferably from a $C_2$–$C_6$aliphatic or from a monocarbocyclic aromatic carboxylic acid. Illustrative examples are the radical of acetic, propionic, β-methoxypropionic, benzoic, aminobenzoic or methylbenzoic acid. Exemplary of $C_1$–$C_4$alkoxycarbonylamino groups as substituents of a benzene nucleus Z are methoxycarbonylamino, ethoxycarbonylamino or butoxycarbonylamino.

If the radical Z contains as substituents phenylethyl, styryl, phenyl, phenoxy, phenylthio- or phenylsulfonyl groups, then said substituents may be substituted by chlorine or bromine, $C_1$–$C_4$alkyl groups such as the methyl or ethyl group, $C_1$–$C_4$alkoxy groups such as methoxy, acylamino groups such as the acetyl or benzoylamino group, or alkoxycarbonylamino groups such as methoxycarbonylamino or ethoxycarbonylamino.

Optionally, also several of the substituents of the benzene nucleus Z mentioned above or of its substituents containing aryl groups can be present simultaneously. These may be identical or different.

Z as a radical of a naphthalene nucleus may additionally be substituted by $C_1$–$C_4$alkyl or alkoxy groups such as methyl or methoxy.

The sulfo group W in formula (1) is preferably free, but may also be in the form of its alkali metal or alkaline earth metal salts, of the ammonium salt or of the salts of organic bases. Owing to the sparing water-solubility of certain calcium, strontium and barium salts in aqueous media, and also for economic reasons, compounds of formula (1) are preferred in which the group W is in the form of its lithium, sodium, potassium, magnesium or ammonium salt, or of the ammonium salt of an organic nitrogen base whose cation has the formula (6)

$$\overset{+}{N}R'R''R'''R'''' \qquad (6)$$

wherein

R', R'', R''', R'''' are each independently of one another hydrogen, a $C_1$–$C_4$alkyl or β-hydroxy-$C_1$–$C_4$alkyl radical or a cyclohexyl radical, with the proviso that at least two of these radicals are able to form with each other a carbocyclic or heterocyclic ring system.

Exemplary of organic nitrogen bases which, with the group W, are able to form such ammonium salts are: trimethylamine, triethylamine, triethanolamine, diethanolamine, ethanolamine, cyclohexylamine, dicyclohexylamine, hexamethyleneimine or morpholine.

Compounds having a particularly good stablising action are compounds of formula (7)

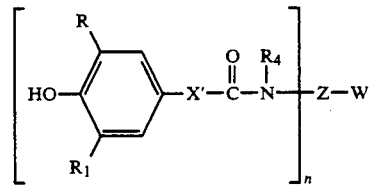

(7)

wherein

R and $R_1$ are each independently of the other methyl or tert-butyl, $R_4$ is hydrogen or $C_1$–$C_4$alkyl, X'' is $C_1$–$C_4$alkylene, Z is ethylene, a divalent or trivalent radical of benzene or naphthalene or is a divalent radical of diphenyl ether, W is the sulfo group, and n is 1 or 2.

The group W in these compounds may be in the free form or also in the form of its salts as defined above.

The water-soluble compounds of formula (1) are known, for example from U.S. patent specification 3,665,031, and can be prepared by methods which are known per se, for example by reacting n mol of a compound of formula (8)

$$A-(X)_x-P \qquad (8)$$

with 1 mol of a compound of formula (9)

$$[W\text{-}]_m Z[\text{-}(X')_{x'}-Q]_n \qquad (9)$$

in which formulae one of P and Q is the group —NH—$R_3$ and the other is the group

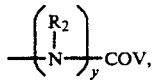

V, where y=1, is the —OAr group and, where y=0, is a chlorine or bromine atom or a reactive amino group, and Ar is an aromatic radical of the benzene or naphthalene series, and A, Z, W, $R_2$, X, X', x, m, n and y are as defined hereinbefore with the elimination of HV.

Representative examples of starting compounds of formula (10)

$$A-(X)_x-NH-R_3 \qquad (10)$$

wherein A, X, x and $R_3$ are as defined above, which compounds fall under formula (8) and are suitable for the preparation of the water-soluble compounds of this invention, are: 4-hydroxy-3,5-di-tert-butylaniline, 4-hydroxy-3,5-di-tert-butylbenzylamine, γ-(4-hydroxy-3,5-di-tert-butylphenyl)propylamine, 4-hydroxy-3-tert-butyl-5-methylaniline, 4-hydroxy-3,5-dicyclohexylaniline, 4-hydroxy-3,5-di-tert-amylaniline, 4-hydroxy-3,5-dicyclohexylbenzylamine, 4-hydroxy-3-methylcyclohexyl-5-methylaniline, 2-hydroxy-3-α,α-dimethylbenzyl-5-methylbenzylamine, 4-hydroxy-3,5-dibenzylaniline, γ-(4-hydroxy-3,5-dibenzylphenyl)propylamine, 2-hydroxy-3-tert-butyl-5-dodecylaniline, 4-hydroxy-3-tert-octyl-5-methylbenzylamine, 4-hydroxy-3,5-diisopropylbenzylamine, 4-hydroxy-3-tert-butyl-6-methylbenzylamine, 4-hydroxy-3,5-di-tert-amylbenzylamine, 2-hydroxy-3,5 -dimethylaniline and 2-hydroxy-3-tert-butyl-5-methlbenzylamine.

Representative examples of starting compounds of formula (11)

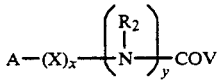

(11)

wherein A, X, x, $R_2$, y and V are as defined above, which compounds fall under formula (8) are: β-(4-hydroxy-3,5-di-tert-butylphenyl)propionylchloride, 4-hydroxy-3,5-di-tert-butylphenylacetylchloride, 4-hydroxy-3,5-di-tert-butylbenzoyl chloride, 4-hydroxy-3-tertbutyl-5-methylphenylacetylchloride, 2-hydroxy-3,5-dimethylbenzoyl chloride, 2-hydroxy-3-tert-butyl-5-methylbenzoyl chloride, S-(4-hydroxy-3-tert-butyl-5-methylbenzyl)thioglycolyl chloride, 4-hydroxy-5-tert-butylphenylacetyl chloride, β-(4-hydroxy-3,5-dicyclohexylphenyl)propionyl bromide, (4-hydroxy-3,5-dicyclohexylphenyl)acetyl chloride, β-(4-hydroxy-3-benzyl-5-methylphenyl)propionyl chloride, (4-hydroxy-3-benzyl-5-methylphenyl)acetyl chloride, 4-hydroxy-3,5-diisopropylphenylacetyl chloride, S-(4-hydroxy-3,5-diisopropylbenzyl)thioglycolyl chloride, β-[ω-(4-hydroxy-3,5-di-tert-butylphenyl)propoxy]propionyl chloride, [ω-(4-hydroxy-3,5-di-tert-butylphenyl)propoxy]acetyl chloride, β-methyl-β-(4-hydroxy-3,5-di-tert-butylphenyl)propionyl chloride, 4-hydroxy-3,5-di-tert-amylbenzyloxyacetyl chloride, and 4-hydroxy-5-tert-butyl-3-ethylbenzyloxyacetyl chloride.

Representative examples of starting compounds of formula (12)

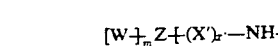

(12)

wherein W, m, Z, X', x', $R_3$ and n are as defined above, which compounds fall under formula (9), are: 2-aminobenzenesulfonic acid, 3-aminobenzenesulfonic acid, 4-aminobenzenesulfonic acid, 5-chloro-2-aminobenzenesulfonic acid, 5-methyl-4-chloro-2-aminobenzenesulfonic acid, 2-chloro-5-aminobenzenesulfonic acid, 4-chloro-3-aminobenzenesulfonic acid, 5-chloro-3-methyl-3-aminobenzenesulfonic acid, 2,5-dichloro-4-aminobenzenesulfonic acid, 3-bromo-6-aminobenzenesulfonic acid, 3,4-dichloro-6-aminobenzenesulfonic acid, 1-aminotetraline-4-sulfonic acid, 1-aminobenzene-2,5-disulfonic acid, 1-aminobenzene-2,4-disulfonic acid, 1,3-diaminobenzene-4-sulfonic acid, 1,4-diaminobenzene-2-sulfonic acid, 2-amino-5-methyl-benzenesulfonic acid, 5-amino-2,4-dimethylbenzenesulfonic acid, 4-amino-2-methylbenzenesulfonic acid, 3-amino-5-isopropyl-2-methylbenzenesulfonic acid, 2-amino-4,5-dimethylbenzenesulfonic acid, 2-amino-4,5-dimethoxybenzenesulfonic acid, 5-amino-2-methylbenzenesulfonic acid, 2-amino-5-ethylbenzenesulfonic acid, 1-aminonaphthalene-3-sulfonic acid, 1-aminonaphthalene-4-sulfonic acid, 1-aminonaphthalene-5-sulfonic acid, 1-aminonaphthalene-6-sulfonic acid, 1-aminonaphthalene-7-sulfonic acid, 1-aminonaphthalene-8-sulfonic acid, 2-aminonaphthalene-1-sulfonic acid, 2-aminonaphthalene-5-sulfonic acid, 2-aminonaphthalene-6-sulfonic acid, 1-aminonaphthalene-3,6-disulfonic acid, 1-aminonaphthalene-3,8-disulfonic acid, 2-aminonaphthalene-4,8-disulfonic acid 1,4-diaminonaphthalene-6-sulfonic acid, 3-amino-4-methoxybenzenesulfonic acid, 1-amino-2-methoxynaphthalene-6-sulfonic acid, 3-amino-4-hydroxybenzenesulfonic acid, 3-amino-6-hydroxy-benzene-1,5-disulfonic acid, 2-amino-5-hydroxynaphthalene-7-sulfonic acid, 2-acetamido-5-aminobenzenesulfonic acid, 2-amino-5-(p-aminobenzoylamino)benzenesulfonic acid, 2-amino-naphthalene-5,7-disulfonic acid, 2-aminonaphthalene-6,8-disulfonic acid, 2-amino-5-benzamido-benzenesulfonic acid, 4,4'-diaminothiodiphenylether-2,2'-disulfonic acid, 2-amino-4-carboxy-5-chloro-benzenesulfonic acid, 4-amino-3-carboxy-benzenesulfonic acid, 5-amino-3-sulfosalicylic acid, 2-(β-phenylethyl)-5-aminobenzenesulfonic acid, 1,2-bis[4-amino-2-sulfophenyl]ethane, 4,4'-diaminostilbene-2,2'-disulfonic acid, 4-aminostilbene-2-sulfonic acid, 4,4'-diamino-2'-methoxystilbene-2-sulfonic acid, 4-aminodiphenylether-3-sulfonic acid, 2-aminodiphenylther-4-sulfonic acid, 2-amino-2'-methyldiphenylether-4-sulfonic acid, 2-amino-4-chloro-4'-amyldiphenylether-5-sulfonic acid, 2-amino-4,4'-dichlorodiphenylether-2'-sulfonic acid, 2-amino-4'-methyldiphenylsulfone-4-sulfonic acid, 2,5-diamino-2'-methyldiphenylether-4-sulfonic acid, benzidine-2,2'-disulfonic acid, 3,3'-dimethylbenzidine-6-sulfonic acid, benzidine-2-sulfonic acid, 2'-aminodiphenylsulfone-3-sulfonic acid, 5'-amino-2'-methyldiphenylsulfone-3-sulfonic acid, 2',5'-diamino-4-methyldiphenylsulfone-3-sulfonic acid, 3'-amino-4'-hydroxy-diphenylsulfone-3-sulfonic acid, 3,3'-diaminodiphenylsulfone-4,4'-disulfonic acid, N-ethylaniline-4-sulfonic acid, N-methyl-2-naphthylamine-7-sulfonic acid, 2-aminoethanesulfonic acid, N-methyl-, N-ethyl-, N-propyl-, N-isopropyl-, N-amyl-, N-hexyl-, N-cyclohexyl-, N-octyl-, N-phenyl-, N-dodecyl- or N-stearyl-2-aminoethanesulfonic acid, 2-methyl-2-aminoethanesulfonic acid, ω-aminopropanesulfonic acid, ω-aminobutanesulfonic acid, ω-aminopentanesulfonic acid, N-methyl-γ-aminopropanesulfonic acid, 1,2-diaminoethanesulfonic acid, 2-methylaminopropanesulfonic acid, and 2-amino-2-carboxyethanesulfonic acid.

Representative examples of starting compounds of formula (13)

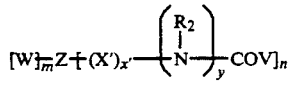

(13)

wherein W, m, Z, X', x', $R_2$, y, V and n are as defined above, which compounds fall under formula (9), are: 2-sulfobenzoyl chloride, 3-sulfobenzoyl chloride, 4-sulfobenzoyl chloride, 3,5-disulfobenzoyl chloride, 3-sulfophthaloyl chloride, 3,4-disulfophthaloyl chloride, 4-sulfophenylacetyl chloride, β-(4-sulfophenyl)propionyl chloride, 3-sulfo-6-methylbenzoyl chloride.

Some of the above starting compounds are known and can be prepared by methods which are known per se.

The preparation of the eligible compounds of formula (1) is described in more detail in U.S. patent specification 3,665,031.

Representative examples of compounds of formula (1) which are eligible for use in the practice of this invention are compounds of formula

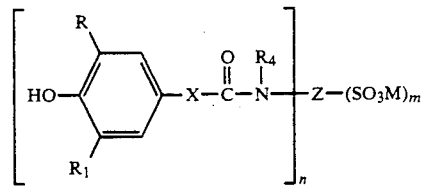

(14)

wherein R, $R_1$, $R_4$ X, Z, M, m and n have the following meanings.

TABLE 1

| Compound | R | $R_1$ | X | $R_4$ | Z—$SO_3M$ | M | m/n | m.p. °C. | $\lambda_{max}$ nm |
|---|---|---|---|---|---|---|---|---|---|
| 1 | $tertC_4H_9$ | $tertC_4H_9$ | $C_2H_4$ | H | 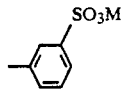 | H | 1/1 | >200 | 242 |
| 2 | $tertC_4H_9$ | $tertC_4H_9$ | $C_2H_4$ | H | 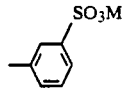 | Na | 1/1 | | 242 |
| 3 | $tertC_4H_9$ | $tertC_4H_9$ | $C_2H_4$ | H | 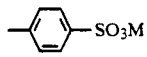 | H | 1/1 | 190 | 254 |
| 4 | $tertC_4H_9$ | $tertC_4H_9$ | $C_2H_4$ | H | 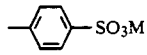 | Na | 1/1 | | |
| 5 | $CH_3$ | $tertC_4H_9$ | $C_2H_4$ | H | 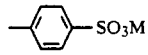 | H | 1/1 | | 254 |
| 6 | $tertC_4H_9$ | $tertC_4H_9$ | $C_2H_4$ | H | 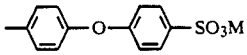 | H | 1/1 | >220 | 250 |
| 7 | $tertC_4H_9$ | $tertC_4H_9$ | $C_2H_4$ | H | 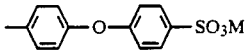 | Na | 1/1 | | |
| 8 | $tertC_4H_9$ | $tertC_4H_9$ | $C_2H_4$ | H | 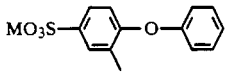 | H | 1/1 | | |
| 9 | $tertC_4H_9$ | $tertC_4H_9$ | $C_2H_4$ | H | 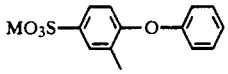 | Na | 1/1 | | |
| 10 | $tertC_4H_9$ | $tertC_4H_9$ | $C_2H_4$ | H | 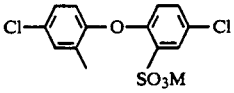 | H | 1/1 | 198 | 282 |
| 11 | $tertC_4H_9$ | $tertC_4H_9$ | $C_2H_4$ | H | 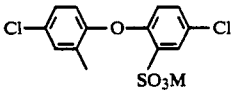 | Na | 1/1 | | |
| 12 | $tertC_4H_9$ | $tertC_4H_9$ | $C_2H_4$ | H | 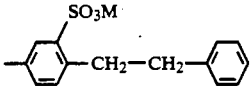 | H | 1/1 | 100 | 251 |
| 13 | $tertC_4H_9$ | $tertC_4H_9$ | $C_2H_4$ | H | 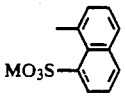 | H | 1/1 | >200 | 298 |

TABLE 1-continued

| Compound | R | $R_1$ | X | $R_4$ | Z—$SO_3M$ | M | m/n | m.p. °C. | $\lambda_{max}$ nm |
|---|---|---|---|---|---|---|---|---|---|
| 14 | tert$C_4H_9$ | tert$C_4H_9$ | $C_2H_4$ | H | 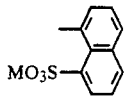 | Na | 1/1 | | |
| 15 | tert$C_4H_9$ | tert$C_4H_9$ | $C_2H_4$ | H | 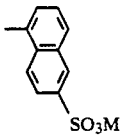 | H | 1/1 | | 280 |
| 16 | tert$C_4H_9$ | tert$C_4H_9$ | $C_2H_4$ | H | 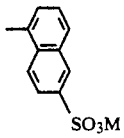 | Na | 1/1 | | |
| 17 | (tert$C_4H_9$)$_2$ | (tert$C_4H_9$)$_2$ | ($C_2H_4$)$_2$ | (H)$_2$ | 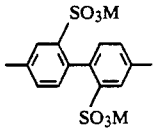 | H | 2/2 | | 260 |
| 18 | tert$C_4H_9$ | tert$C_4H_9$ | $C_2H_4$ | $CH_3$ | —$CH_2$—$CH_2$—$SO_3M$ | H | 1/1 | 224 | 276 |
| 19 | tert$C_4H_9$ | tert$C_4H_9$ | $C_2H_4$ | $CH_3$ | —$CH_2$—$CH_2$—$SO_3M$ | Na | 1/1 | | |
| 20 | tert$C_4H_9$ | tert$C_4H_9$ | $C_2H_4$ | H | 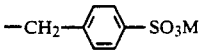 | H | 1/1 | | 273 |
| 21 | tert$C_4H_9$ | tert$C_4H_9$ | — | H | 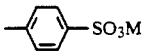 | H | 1/1 | | 280 |
| 22 | tert$C_4H_9$ | tert$C_4H_9$ | NH | H | 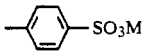 | Na | 1/1 | | |
| 23 | tert$C_4H_9$ | tert$C_4H_9$ | $CH_2$ | H | 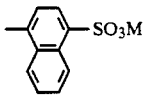 | H | 1/1 | >210–220 | |
| 24 | tert$C_4H_9$ | tert$C_4H_9$ | $CH_2$ | H | 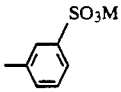 | H | 1/1 | >250 | |
| 25 | tert$C_4H_9$ | tert$C_4H_9$ | $C_2H_4$ | H | 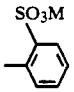 | H | 1/1 | >180 | |
| 26 | tert$C_4H_9$ | tert$C_4H_9$ | $C_2H_4$ | H | 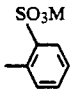 | 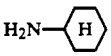 | 1/1 | 210 | |
| 27 | tert$C_4H_9$ | tert$C_4H_9$ | NH | H | 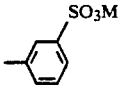 | H | 1/1 | | |
| 28 | tert$C_4H_9$ | tert$C_4H_9$ | NH | H | 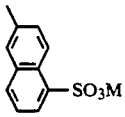 | 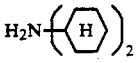 | 1/1 | | |
| 29 | tert$C_4H_9$ | tert$C_4H_9$ | $C_2H_4$ | H | —$CH_2$—$CH_2$—$SO_3M$ | H | 1/1 | 240 | |

TABLE 1-continued

| Compound | R | $R_1$ | X | $R_4$ | Z—$SO_3M$ | M | m/n | m.p. °C. | $\lambda_{max}$ nm |
|---|---|---|---|---|---|---|---|---|---|
| 30 | $(tertC_4H_9)_2$ | $(tertC_4H_9)_2$ | $(C_2H_4)_2$ | $(H)_2$ | 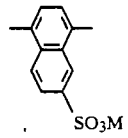 | H | 1/2 | 192 | |
| 31 | $tertC_4H_9$ | $tertC_4H_9$ | $C_2H_4$ | H | 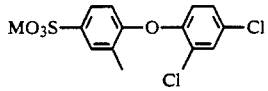 | H | 1/1 | 142 | |
| 32 | $tertC_4H_9$ | $tertC_4H_9$ | $C_2H_4$ | H | 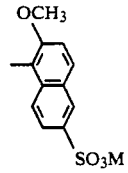 | H | 1/1 | 185 | |
| 33 | $tertC_4H_9$ | $tertC_4H_9$ | $C_2H_4$ | H | 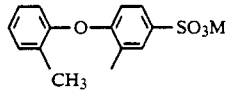 | H | 1/1 | | |
| 34 | $tertC_4H_9$ | $tertC_4H_9$ | $C_2H_4$ | H | 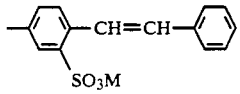 | H | 1/1 | >300 | |
| 35 | $tertC_4H_9$ | $tertC_4H_9$ | NH | $CH_3$ | $-CH_2-CH_2-SO_3M$ | H | 1/1 | | |
| 36 | $tertC_4H_9$ | $tertC_4H_9$ | NH | H | $-CH_2-CH_2-SO_3M$ | 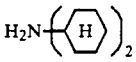 | 1/1 | 153–155 | |
| 37 | $tertC_4H_9$ | $tertC_4H_9$ | $C_2H_4$ | H | 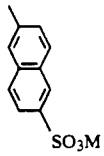 | H | 1/1 | >250 | |
| 38 | $tertC_4H_9$ | $tertC_4H_9$ | $C_2H_4$ | H | 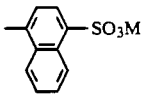 | H | 1/1 | 208 | |
| 39 | $tertC_4H_9$ | $tertC_4H_9$ | $CH_2$ | H | 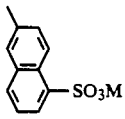 | H | 1/1 | >210 | |
| 40 | $tertC_4H_9$ | $tertC_4H_9$ | $C_2H_4$ | H | 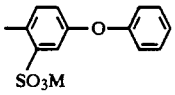 | H | 1/1 | >200 | |
| 41 | $tertC_4H_9$ | $tertC_4H_9$ | $C_2H_4$ | $C_2H_5$ | 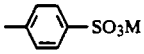 | H | 1/1 | 180 | |
| 42 | $tertC_4H_9$ | $tertC_4H_9$ | $C_2H_4$ | H | 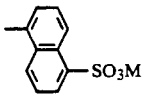 | H | 1/1 | 204 | |

TABLE 1-continued

| Compound | R | $R_1$ | X | $R_4$ | Z—$SO_3M$ | M | m/n | m.p. °C. | $\lambda_{max}$ nm |
|---|---|---|---|---|---|---|---|---|---|
| 43 | $isoC_3H_7$ | $isoC_3H_7$ | $C_2H_4$ | H | 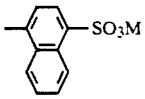 | H | 1/1 | 210 | |
| 44 | $tertC_4H_9$ | $tertC_4H_9$ | — | H | 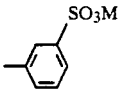 | Na | 1/1 | | |

as well as the compounds of formulae (45)

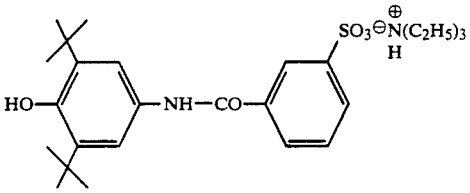

$\lambda_{max}$ 284 nm and (46)

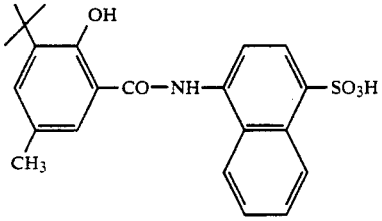

m.p. 190° C.

The compounds of formula (1) are applied from an aqueous bath which contains the compounds in an amount of 0.01 to 10% by weight, preferably 0.25 to 3% by weight.

The application of the water-soluble phenolic antioxidant can be made during or after dyeing by an exhaust or continuous process. Application during dyeing is preferred.

In the exhaust process, the liquor to goods ratio may be chosen within a wide range, typically from 1:3 to 1:100, preferably from 1:10 to 1:40. The process is conveniently carried out in the temperature range from 30° to 130° C., preferably from 50° to 95° C.

In the continuous process the pick-up is conveniently 40–700% by weight, preferably 40–500% by weight. The fabric is then subjected to a heat treatment to fix the dyes and the antioxidant. Fixation can also be effected by the cold pad-batch process.

The heat treatment is preferably made by steaming in a steamer with steam or superheated steam in the temperature range from 98° to 105° C. for typically 1 to 7, preferably 1 to 5, minutes. Dye fixation by the cold pad-batch process can be effected by storing the impregnated fabric, which is preferably rolled up, at room temperature (15° to 30° C.) for typically 3 to 24 hours. It is common knowledge that the batching time depends on the dye.

Upon completion of the dyeing process and fixation, the dyeings are washed and dried in conventional manner.

The dyeings obtained in the process of this invention have good thermal and/or photochemical stability.

Dyeings to be stabilised by the process of this invention are suitably those obtained with disperse, acid or metal complex dyes, preferably with azo dyes or 1,2-metal complex dyes such as 1:2-chromium complex dyes, 1:2-cobalt complex dyes or copper complex dyes. Preferred dyeings, but without implying any restriction thereto, are those obtained with red dyes or with dye mixtures containing a red component. Examples of such dyes are listed in the Colour Index, 3rd edition, 1971, Volume 4.

Polyamide material will be understood as meaning synthetic polyamide such as polyamide 6, polyamide 66 or polyamide 12, as well as modified polyamide, for example basic dyeable polyamide. In addition to pure polyamide, blends of polyurethane and polyamide are also particularly suitable, for example tricot fabric of polyamide/polyurethane in the ratio of 70:30. In principle, the pure or blended polyamide material can be in any form of presentation, for example fibres, yarn, woven and knitted goods, nonwovens or pile fabric.

Especially suitable for treatment by the process of this invention are dyeings on polyamide material which is exposed to light and/or heat, for example carpets or automotive fabric.

The process is also suitable for heat stabilising dyed polyamide material intended for the "moulding" process. In this process the fabric is moulded briefly at elevated temperature (for example in brassiere manufacture)

The invention is illustrated by the following Examples, in which parts and percentages are by weight.

EXAMPLE 1

Two polyamide 6 knitwear samples, each weighing 10 g, are dyed in an ®AHIBA dyeing machine at a liquor to goods ratio of 1:30. For dyeing, two liquors are prepared comprising 0.5 g/l of monosodium phosphate and 1.5 g/l of disodium phosphate (=pH 7) and 0.2% of the dye of formula (100)

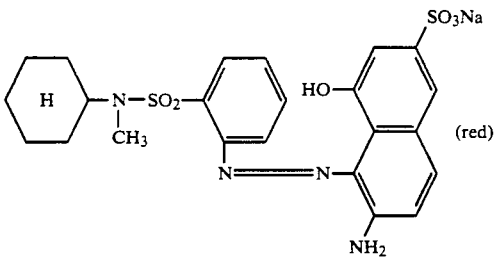

(red)

in dissolved form.

Liquor (1) contains no further ingredients, but liquor (2 contains) 1% of the compound of formula (101)

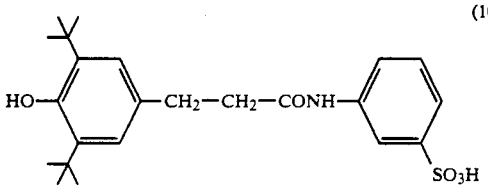

Dyeing is commenced at 30° C. and this temperature is kept for 10 minutes and then raised by 2½°/min to 95° C. After a dyeing time of 20 minutes at 95° C., 2% of acetic acid (80%) is added and dyeing is continued for 20 minutes. After cooling to 50° C., the fabric samples are rinsed, centrifuged and dried.

The dyeings are tested for their lightfastness according to SN-ISO 105-BO2 (Xenon) and DIN 75 202 (Fakra) and also for their shade stability in a heat test for 60 seconds at 130° C. in a circulating air drier.

Results

| Dyeing | Lightfastness XENON | Lightfastness FAKRA 72 h | Heat test 130° C.: 60 h |
|---|---|---|---|
| 1 | −7 | −4 | dull brownish pale red |
| 2 | 7 | −6-7 | brilliant pale red |

It is evident from these results that compound (101) affords the dyeing photochemical as well as thermal protection.

EXAMPLE 2

The procedure of Example 1 is repeated, using in place of the dye of formula (100) 0.4% of the dye of formula (200)

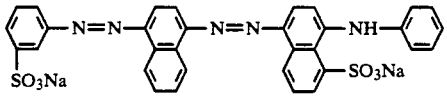

(navy blue)

Testing gives the following results:

| Dyeing | Lightfastness XENON | Lightfastness FAKRA 72 h | Heat test 130° C.; 60 h |
|---|---|---|---|
| 3 | 4 | <4 | grey* |
| 4 | 4-5 | 4 | blue: trace greyer than original |

*dye destroyed

It is evident that compound (101) affords the dyeing in particular thermal protection.

EXAMPLE 3

The procedure of Example 1 is repeated, using in place of the dye of formula (100) 0.15% of the dye of formula (300)

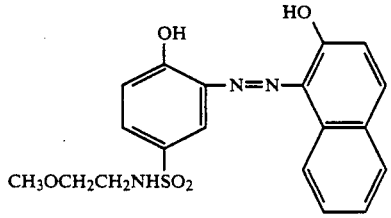

1:2 Co complex (bordeaux)

The tests for lightfastness and heat stability gives the following results:

| Dyeing | Lightfastness XENON | Lightfastness FAKRA 72 h | Heat test 130° C.; 60 h |
|---|---|---|---|
| 5 | 7-8 | 4 | *light brown |
| 6 | 7-8 | −7 | almost unchanged |

*dye destroyed

Here too a stabilisation of the dye against light and heat is observed.

EXAMPLE 4

Two polyamide 6 knitwear samples, each weighing 10 g, are dyed beige in an ®AHIBA dyeing machine at a liquor to goods ratio of 1:30. For dyeing, two liquors are prepared comprising 0.5 g/l of monosodium phosphate and 1.5 g/l of disodium phosphate (=pH 7) and 0.2% of the mixture of dyes, in dissolved form, comprising 0.04% of the dye of formula (100) as indicated in Example 1, 0.08% of the dye of formula (400)

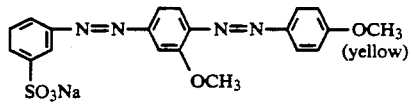

(yellow)

0.08% of the dye of formula (401)

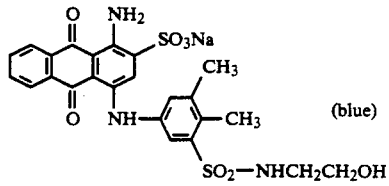

(blue)

Liquor (1) contains no further ingredients, but liquor (2) contains 1% of the compound of formula (402)

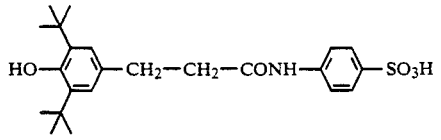

The test results are as follows:

| Dyeing | Lightfastness XENON | Lightfastness FAKRA 72 h | Heat test 130° C.; 60 h |
|---|---|---|---|
| 7 | 5-6 | 1-2 | -olive green |
| 8 | 5-6 | 2-3 | -unaltered beige |

The results show that the addition of compound (402) effects in addition to a hot light stabilisation in particular a heat stabilisation of the red dye of formula (100).

EXAMPLE 5

Five polyamide knitwear samples, each weighing 10 g, are each dyed separately as described in Example 1 with the following combination of 0.002% of the dye of formula (300) as indicated in Example 3 and 0.04% of the mixture of dyes of formulae (402) and (403), and of 81 parts of the dye of formula (500)

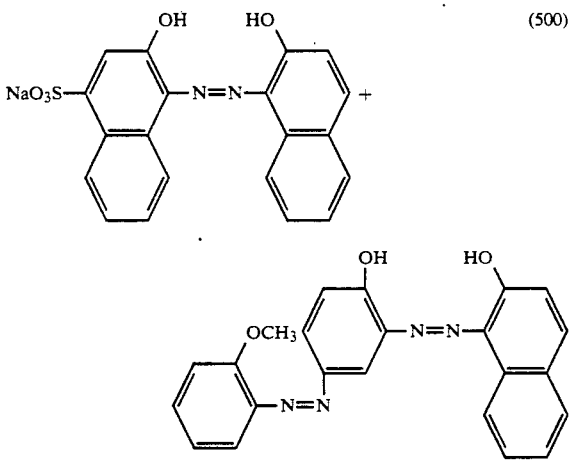

1:2 Cr complex and 12 parts of the dye of formula (501)

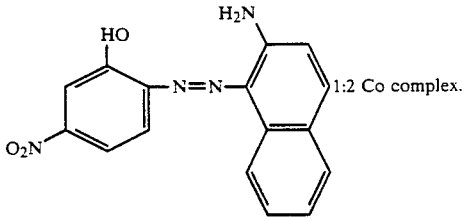

Dyebath 1 contains no further ingredients, whereas baths 2-6 each contain 1% of the compounds of formulae (502)-(506) in dissolved form.

(502)

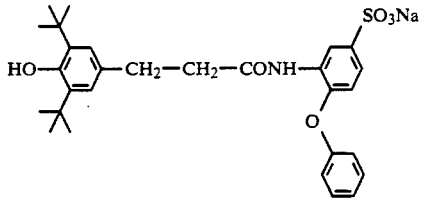

(503)

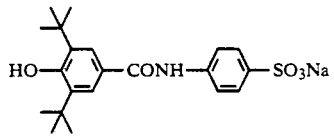

(504)

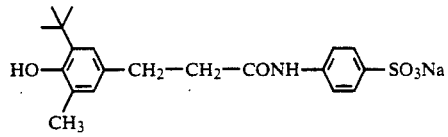

(505)

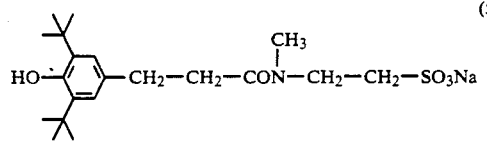

(506)

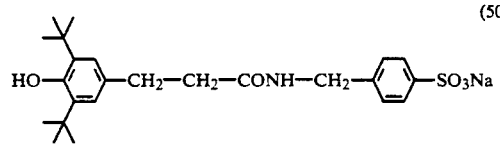

The dyeings are tested for their lightfastness properties according to DIN75 202 (FAKRA), for their loss of mechanical properties (test according to Ser. No. 198,461), and for their heat stability. The following results are obtained.

| Dye-bath | Lightfastness* FAKRA 72 h | Lightfastness* FAKRA 144 h | tensile strength/elongation in % after 216 h Fakra | | Heat test 130° C., 60 h |
|---|---|---|---|---|---|
| 1. | 2 H | 1 H | 2.9 | 22.4** | change in shade from grey → beige |
| 2. | 4-5 | 3 | 62.4 | 77.0 | all grey dyeings |
| 3. | 3-4 | 1-2 | 46.2 | 63.8 | a trace |
| 4. | 4-5 | 3-4 | 64.2 | 79.4 | more yellow |
| 5. | 4-5 | 3 | 62.0 | 77.1 | no destruction |

-continued

| Dye-bath | Lightfastness* FAKRA 72 h | FAKRA 144 h | tensile strength/elongation in % after 216 h Fakra | | Heat test 130° C., 60 h |
|---|---|---|---|---|---|
| 6. | 4–5 | 3–4 | 52.3 | 72.5 | of dye |

*evaluation against Grey Scale: **material spoiled

It is evident from the results that the grey dyeings are markedly improved by the compounds (502)–(506) with respect to their photochemical and thermal stability.

EXAMPLE 6

Two polyamide 66 tricot samples are dyed violet as described in Example 1 with the following amounts of dye: 0.15% of the dye of formula (100) as indicated in Example 1 and 0.075% of the dye of formula (401) as indicated in Example 4. Dyebath 1 contains no further ingredients, whereas dyebath 2 additionally contains 1.5% of the compound of (402) as indicated in Example 4.

The thoroughly rinsed and dried tricot material is subsequently subjected to a heat treatment under "moulding" conditions (i.e. a heat moulding process used e.g. for making brassiéres). This is done by heating the material under controlled conditions on a precision ironing press "System BASF" (sold by K. Schröder KG, D-Weinheim/Bergstr.). The test results are as follows:

| Press Temp./Time | Shade compared with original dyeing 1 | dyeing 2 |
|---|---|---|
| 190° C.; 1 min | a trace duller | no change |
| 200° C.; 1 min | markedly duller | no change |
| 210° C.; 30 sec. | duller | no change |
| 210° C.; 1 min | much duller | a trace duller |

The results of the accelerated contact heat treatment show that the dyeing containing compound (402) exhibits no or only an insignificant tendency to changes in shade (=dye destruction).

We claim:

1. A process for improving the thermal and/or photochemical stability of dyeings on polyamide fibres, which process comprises applying to said polyamide fibres, from an aqueous medium, a compound of formula (1)

$$(A—Y—)_nZ(—W)_m \quad (1)$$

wherein

A is the radical of a sterically hindered phenol of the benzene series

Y is a radical of formula (2) or (3)

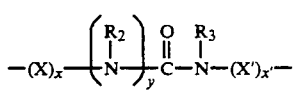

(2)

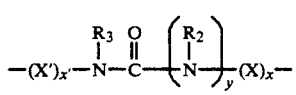

(3)

wherein X and X' are each independently of the other alkylene, oxaalkylene or thiaalkylene, $R_2$ and $R_3$ are each independently of the other hydrogen or an unsubstituted or substituted alkyl group, and x, x' and y are each independently of the other 0 or 1, Z is an aliphatic or a carbocyclic aromatic radical, which last mentioned radical contains not more than two mono- or bicyclic nuclei, W is a sulfo group, and m and n are each independently of the other 1 or 2, or a water-soluble salt thereof, wherein the compound of formula (1) goes on to the fibres by an exhaust or continuous dyeing process.

2. A process according to claim 1, which comprises the use of a compound of formula (1), wherein A is a monohydroxyphenyl radical which is substituted in at least one ortho-position to the hydroxyl group by alkyl of 1 to 12 carbon atoms, cycloalkyl of 6 to 10 carbon atoms or aralkyl of 7 to 10 carbon atoms, and which may carry additional substituents.

3. A process according to claim 1, which comprises the use of a compound of formula (1), wherein A is a radical of formula (4)

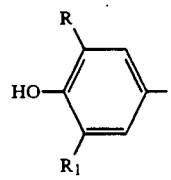

(4)

wherein

R and $R_1$ are each independently of the other hydrogen, methyl or tert-butyl, and the sum of the carbon atoms of R and $R_1$ is not less than 2.

4. A process according to claim 1, wherein X and X' in the compounds of formulae (2) and (3) are straight-chain or branched alkylene of 1 to 8 carbon atoms.

5. A process according to claim 1, wherein $R_2$ und $R_3$ in the compounds of formulae (2) and (3) are straight-chain or branched $C_1$–$C_8$alkyl.

6. A process according to claim 1, wherein $R_2$ and $R_3$ in the compounds of formulae (2) and (3) are hydroxyalkyl, alkoxyalkyl, aminoalkyl, alkylaminoalkyl or dialkylaminoalkyl, each containing a total of 2 to 10 carbon atoms, or are phenyl.

7. A process according to claim 1, wherein Y in formula (1) is a radical of formula (5)

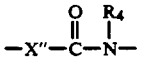

(5)

wherein $R_4$ is hydrogen or $C_1$–$C_4$alkyl and

X'' is $C_1$–$C_4$alkylene.

8. A process according to claim 1, wherein Z in formula (1) is the radical of an unsubstituted or carboxy-substituted lower alkane of at least two carbon atoms, the radical of an unsubstituted benzene nucleus or of a benzene nucleus which is substituted by chlorine or bromine, $C_1$–$C_4$alkyl, $C_1$–$C_4$alkoxy, $C_1$–$C_4$alkoxycarbonylamino, hydroxy, carboxy, phenylethyl, styryl, phenyl, phenoxy, phenylthio, phenylsulfonyl or acylamino, and the group W may be attached direct to said benzene nucleus or to a monocyclic aryl radical of one of the substituents thereof, or is a radical of a naphthalene or tetraline nucleus.

9. A process according to claim 1, which comprises the use of a compound of formula (7)

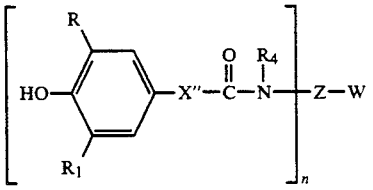

(7)

wherein

R and $R_1$ are each independently of the other methyl or tert-butyl, $R_4$ is hydrogen or $C_1$–$C_4$alkyl, X'' is $C_1$–$C_4$alkylene, Z is ethylene, a divalent or trivalent radical of benzene or naphthalene or is a divalent radical of diphenyl ether, W is the sulfo group, and n is 1 or 2.

10. A process according to claim 9, which comprises the use of a compound of formula (7), wherein R and $R_1$ are tert-butyl, X'' is methylene or ethylene, $R_4$ is hydrogen, methyl or ethyl, and Z is ethylene, o-, m- or p-phenylene, 1,4-naphthylene, 1,8-naphthylene, 2-methoxy-1,6-naphthylene, 1,5-naphthylene, 2,5-naphthylene, 2,6-naphthylene, 1,4,6-naphthalenetriyl or the radicals

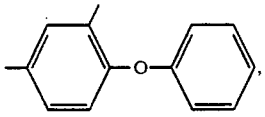

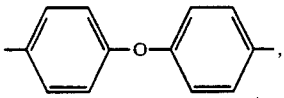

-continued

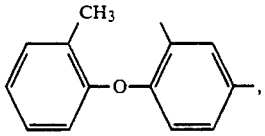

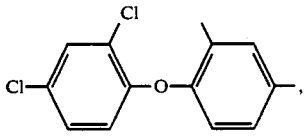

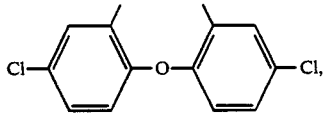

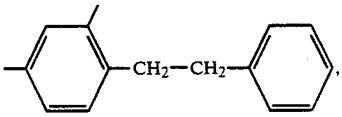

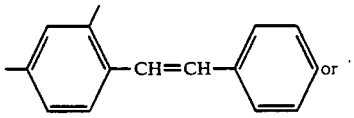

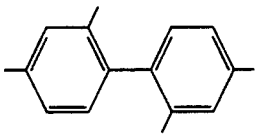

and wherein the sulfo group W may also be in the form of its alkali metal salts or ammonium salts.

11. A process according to claim 1 for improving the thermal and/or photochemical stability of polyamide fibres dyed with acid or metal complex dyes.

12. A process according to claim 11 for improving the thermal and/or photochemical stability of polyamide fibres dyed with red acid or 1:2 metal complex dyes or with a mixture of dyes containing a red component.

13. Dyeings on polyamide fibres treated by the process as claimed in claim 1.

* * * * *